US006742553B2

(12) United States Patent
Sato et al.

(10) Patent No.: US 6,742,553 B2
(45) Date of Patent: Jun. 1, 2004

(54) CUP-TYPE BEVERAGE VENDING MACHINE

(75) Inventors: Takeshi Sato, Isesaki (JP); Ryouichi Sekiguchi, Isesaki (JP); Toshiya Chiku, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/677,531

(22) Filed: Oct. 3, 2003

(65) Prior Publication Data

US 2004/0069370 A1 Apr. 15, 2004

Related U.S. Application Data

(62) Division of application No. 09/901,562, filed on Jul. 11, 2001, now Pat. No. 6,675,985.

(30) Foreign Application Priority Data

Jul. 12, 2000 (JP) ..... 2000-210957
Jul. 12, 2000 (JP) ..... 2000-211593

(51) Int. Cl.[7] ..... B65B 1/04
(52) U.S. Cl. ..... 141/174; 221/96; 222/129.1
(58) Field of Search ..... 141/174, 175; 221/96; 222/129.1

(56) References Cited

U.S. PATENT DOCUMENTS 1,534,982 A 4/1925 McIellan
1,737,784 A 12/1929 Cherry
3,530,907 A * 9/1970 Slass ..... 141/167
3,554,384 A 1/1971 Lane et al.
4,042,148 A 8/1977 Gerben
4,094,345 A 6/1978 Deziel
4,174,742 A * 11/1979 Murphey ..... 141/11
4,738,290 A * 4/1988 Ciekanski ..... 141/82
5,027,869 A * 7/1991 Tsumura et al. ..... 141/104

FOREIGN PATENT DOCUMENTS

| | | |
|---|---|---|
| GB | 2040482 | 9/1980 |
| JP | 02144793 | 6/1990 |
| JP | 03273486 | 12/1991 |
| JP | 07320143 | 12/1995 |
| JP | 08055278 | 2/1996 |

* cited by examiner

*Primary Examiner*—Steven O. Douglas
(74) *Attorney, Agent, or Firm*—Banner & Witcoff, Ltd.

(57) ABSTRACT

In a cup-type beverage vending machine, during conveyance of a beverage-filled cup to a product taking-out position and when the cup does not reach the product taking-out position, a pivot arm is supported by a support roller and a cup on a cup stage is held by a holder. When the cup reaches the product taking-out position, a lower edge of the pivot arm is released from the support roller and the pivot arm and the holder are pivoted downward. Consequently, the holder is spaced downward apart from a front surface of the cup, which allows a customer to easily take out the cup.

8 Claims, 8 Drawing Sheets

CUP-TYPE BEVERAGE VENDING MACHINE

CROSS-REFERENCE TO RELATED APPLICATIONS

This application is a divisional application of U.S. patent application No. 09/901,562, which was filed in the U.S. Patent and Trademark Office on Jul. 11, 2001 now U.S. Pat. No. 6,675,985 and is hereby entirely incorporated by reference. This application is also based upon and claims the benefit of priority from Japanese Patent Application Nos. 2000-211593 and 2000-210957, which were both filed on Jul. 12, 2000 and are hereby entirely incorporated by reference.

BACKGROUND OF THE INVENTION

1. Field of the Invention

The present invention relates to cup-type beverage vending machine which add boiled water, water, ice or the like to various kinds of powder materials such as coffee and cocoa or liquid materials such as syrup to blend them, and vend such blended beverages poured into cups.

2. Description of the Prior Art

A conventionally known beverage vending machine of this type is disclosed in Japanese Patent Laid-open No. 7-320143 specification.

A beverage vending process of this beverage vending machine will be described. When a cup stage is moved below a cup supplying device, a cup is conveyed from the cup supplying device to the cup stage. In order for the cup on the cup stage not to rock or fall, located on the cup stage is a cup holder, which holds the cup. Next, the held cup is moved below a material supplying device, where a material is supplied into the cup. The material-filled cup is then conveyed to a beverage making device. After that, the cup is conveyed to a product taking-out port, and the cup beverage is provided to a customer.

When taking out the cup beverage from the product taking-out port in the beverage vending process of the conventional cup-type beverage vending machine described above, the customer opens a door of the product taking-out port with a hand, inserts the other hand in the product taking-out port toward the back thereof to release the cup holder, and takes out the cup from the product taking-out port.

However, since the cup itself is made of normal paper, soft resin or the like which is easy to be deformed, care must be taken not to apply any force on the cup more than needs when taken out. It is troublesome to carry out such care-requiring work in the back of the product taking-out port with a hand. It is also troublesome to release the cup holder whenever taking out the cup.

SUMMARY OF THE INVENTION

In view of the above conventional problems, an object of the present invention is to provide a cup-type beverage vending machine which requires no opening operation of a cup holder and allows a beverage-filled cup to be easily taken out.

The present invention provides a cup-type beverage vending machine, including: a cup stage on which a cup is located; a beverage pouring section for pouring beverage into the cup; and a conveying device for reciprocating the cup stage between the beverage pouring position and a product taking-out position, in which the machine has a cup holder mechanism which holds the cup on the cup stage when the cup stage is situated other than the product taking-out position, while releases holding condition of the cup when the cup stage is situated in the product taking-out position.

According to the present invention, during conveyance of a beverage-filled cup to the product taking-out position and when the cup has not yet reached the product taking-out position, the cup is held by a cup holder mechanism. While when the cup reaches the product taking-out position, the cup holder mechanism releases holding condition of the cup to allow the cup to be easily taken out.

The above mentioned and other objects, features and advantages of the present invention will become apparent by the following description and the accompanying drawings.

DESCRIPTION OF THE PREFERRED EMBODIMENTS

FIGS. 1 to 6 show a first embodiment of a cup-type beverage vending machine to which the present invention is applied.

Figure 1:
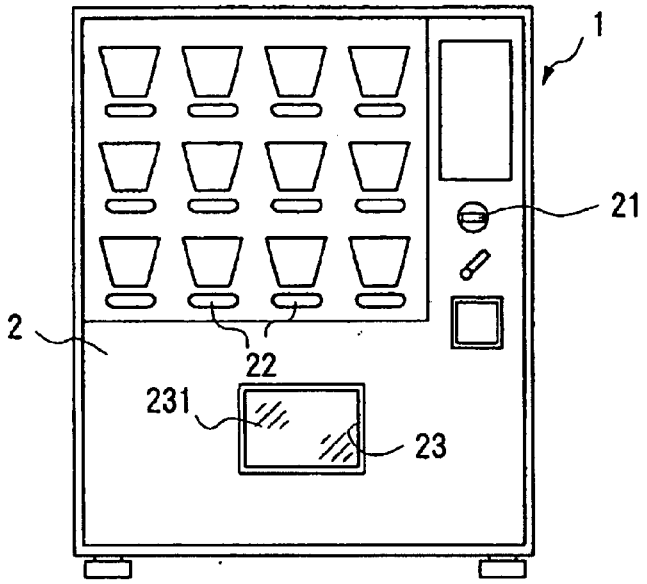
FIG. 1 is a front elevational view of a cup-type beverage vending machine according to a first embodiment.
Figure 2:
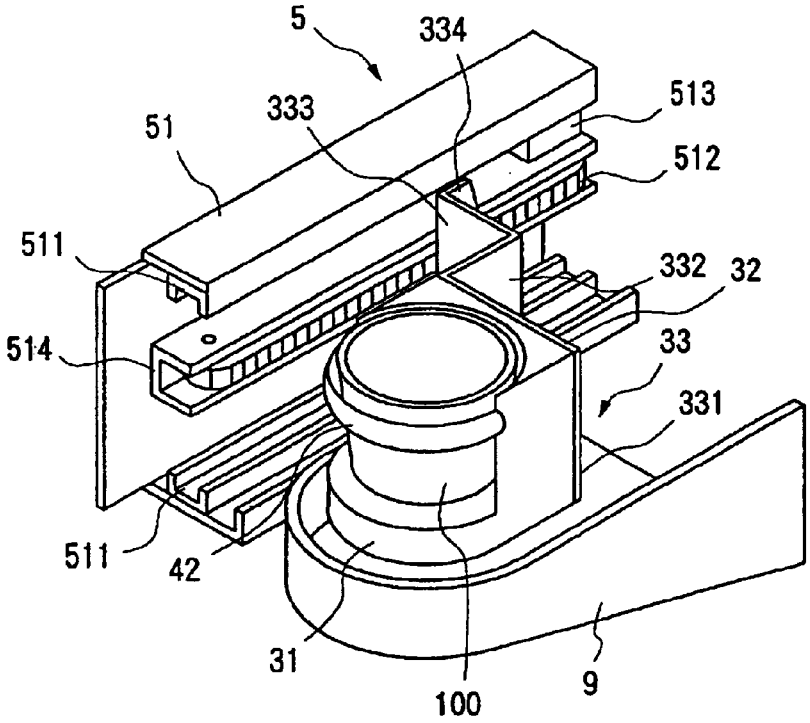
FIG. 2 is a perspective view of an essential part of the cup-type beverage vending machine according to the first embodiment.

First, an appearance of the cup-type beverage vending machine according to the present invention will be described with reference to FIG. 1. The cup-type beverage vending machine 1 provides for pouring extracted beverage such as coffee, cocoa or tea into a cup to be vended as a cup beverage. Located on an outer door 2 of the cup-type beverage vending machine 1 are a coin insert 21, product selecting buttons 22 for selecting products, a product taking-out port 23 from which the cup beverage is taken out, or the like. Their configurations are the same as in a conventional cup-type beverage vending machine.

The cup-type beverage vending machine 1 of the present invention has a feature in cup holding structure, and this structure will be described below with reference to FIGS. 2 to 6.

The cup-type beverage vending machine 1 has a cup stage 3 for accommodating a cup 100. The cup stage 3 has a bottom wall 31 formed in a semi-circular shape at its tip side and a cup holding block 32 formed so as to rise from about the centers of the peripheral side edges to a rear part of the bottom wall 31. Located on the bottom wall 31 is the cup 100. An inner side of the cup holding block 32 is arcuately formed at its section so as to correspond to a side surface of the cup 100, and the cup holding block 32 surrounds a peripheral side surface of the cup 100 from its right and left side surfaces to its rear surface.

Figure 3:
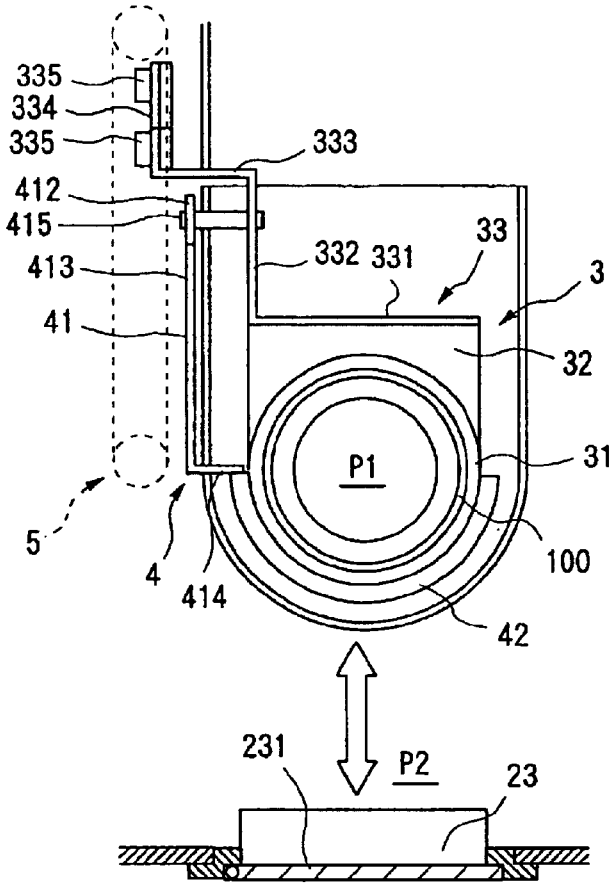
FIG. 3 is a plan view of an essential part of the cup-type beverage vending machine according to the first embodiment.

Furthermore, the cup stage 3 is connected to a belt conveying device 5 described below via a bracket 33. As shown in FIG. 3, the bracket 33 has a first transverse plate 331 fixed on a rear surface of the cup holding block 32, a first longitudinal plate 332 extending backward from a left end of the first transverse plate 331, a second transverse plate 333 extending leftward from a rear end of the first longitudinal plate 332, and a second longitudinal plate 334 extending backward from a left end of the second transverse plate 333. Located on top and bottom ends of the second longitudinal plate 334 are guide rollers 335, which are rollably fitted into below mentioned guide rails 511.

Figure 5:
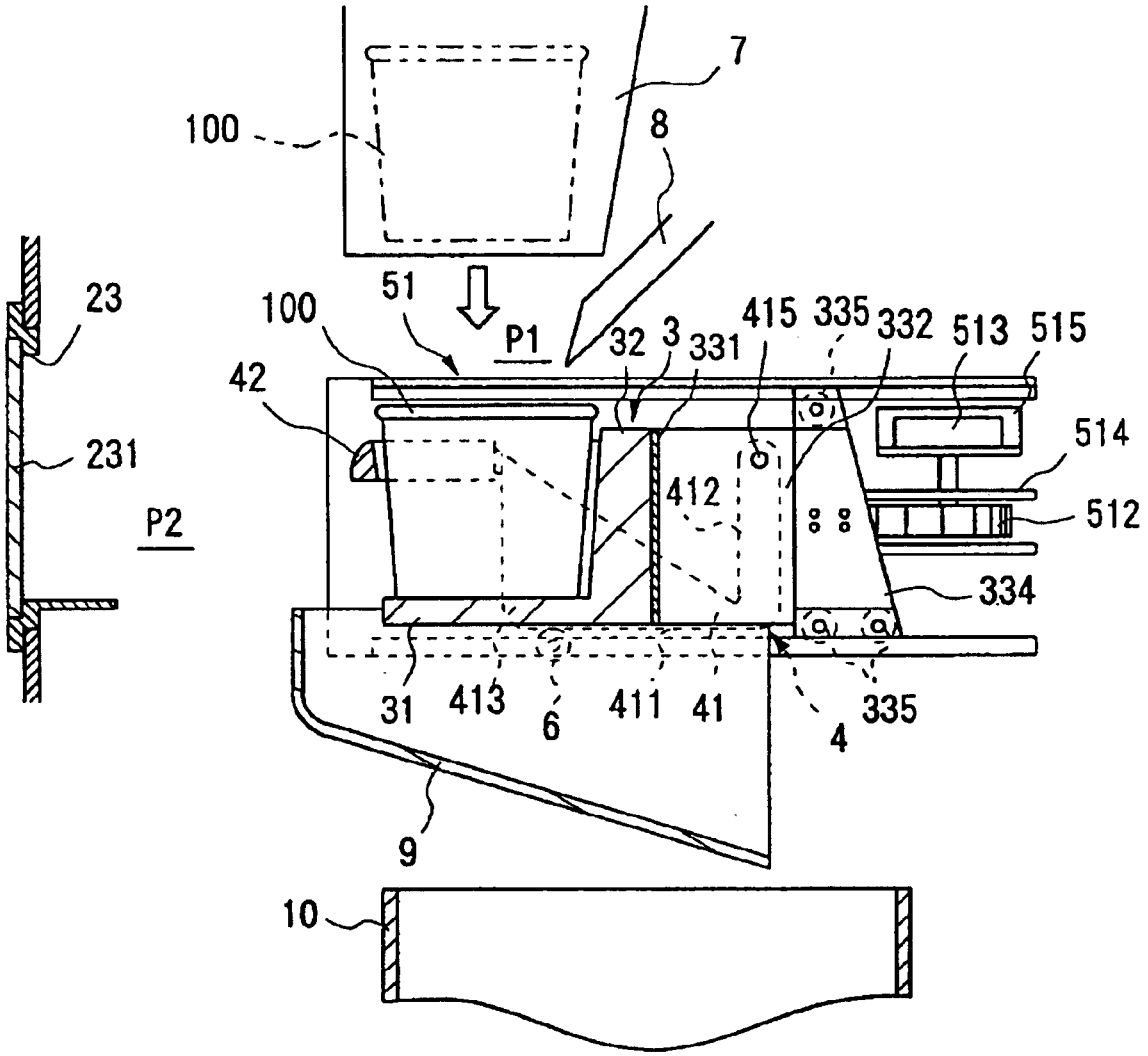
FIG. 5 is a side sectional view of a condition where a cup stage is on standby in a beverage pouring position in the first embodiment.
Figure 6:
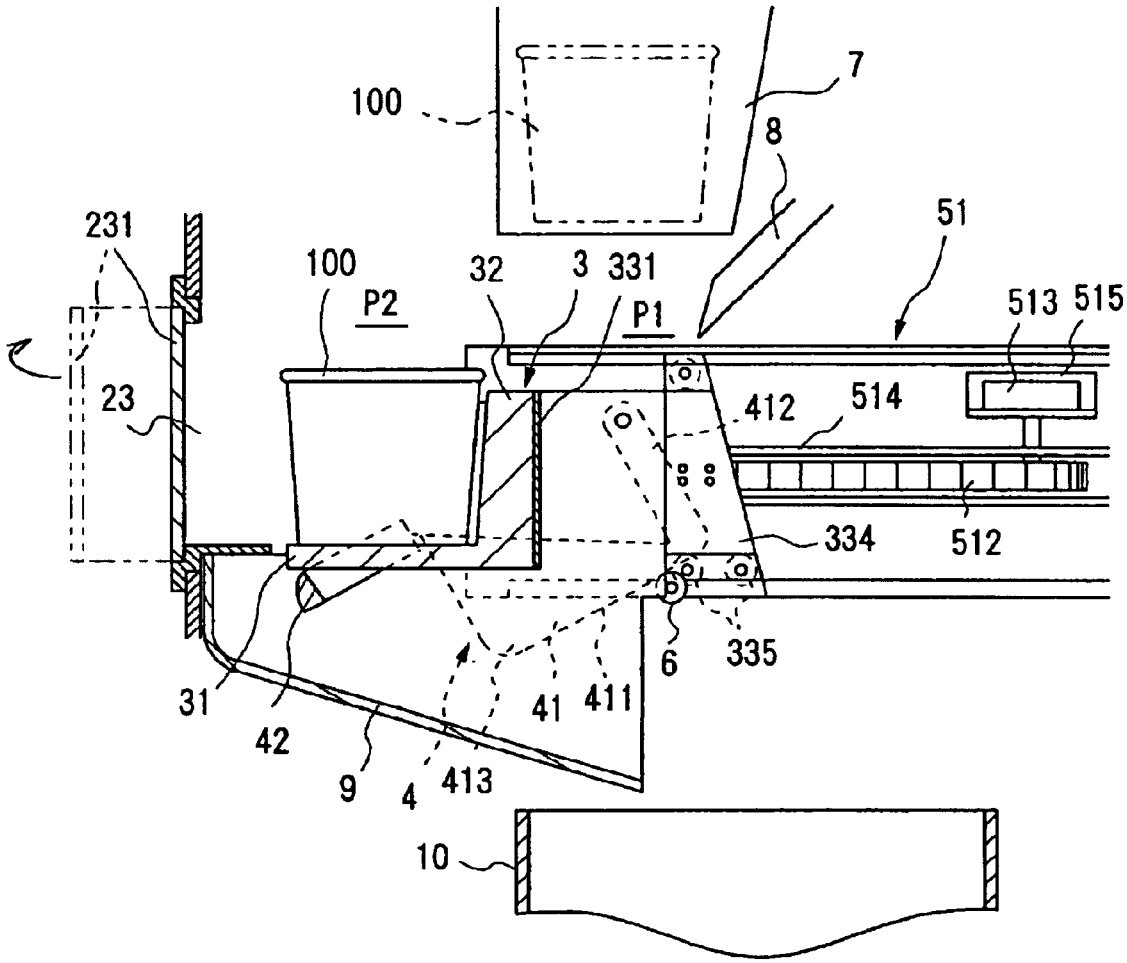
FIG. 6 is a side sectional view of a condition where the cup stage has been conveyed to a product taking-out position in the first embodiment.

The cup-type beverage vending machine 1 has a cup holder mechanism 4 for holding the cup 100. The cup holder mechanism 4 has a pivot arm 41 connected to the first longitudinal plate 332. As shown in FIGS. 5 and 6, the pivot arm 41 includes a first arm 412 extending upward from a rear end of a lower edge 411, a second arm 413 formed to be gradually widened along its height from the rear end to the tip of the lower edge 411 and a connecting plate 414 extending from a top end of the second arm 413 toward the cup 100. The top of the first arm 412 is pivotably mounted on the first longitudinal plate 332 by a pin 415. Consequently, as shown in FIGS. 5 and 6, the center of gravity of the pivot arm 41 is positioned forward of the pin 415, and a downward turning force is applied on the pivot arm 41 by a self weight of the pivot arm 41.

Furthermore, the cup holder mechanism 4 has a holder 42 for holding the cup 100. As shown in FIGS. 2 to 5, the holder 42 is formed in a semi-ring shape so as to cover the upper portion of the cup 100 from its opposite side surfaces to its front surface, and the holder 42 is fixed at its an end to the connecting plate 414 of the pivot arm 41, and as a result, the holder 42 pivots together with pivoting of the pivot arm 41.

The cup-type beverage vending machine 1 has a belt conveying device 5 for conveying the cup stage 3. The belt conveying device 5 is adapted to reciprocate the cup stage 3 between a beverage extracting position P1 and a product taking-out position P2. The belt conveying device 5 has a conveying casing 51 along a conveying path of the cup stage 3. The conveying casing 51 is provided, on its top and bottom plates, with guide rails 511 extending backward and forward, into which guide rollers 335 are fitted. The belt conveying device 5 has an endless belt 512 hung across the conveying casing 51. The endless belt 512 is driven by a reversible belt motor 513 and connected to the second longitudinal plate 334 such that the cup stage 3 is moved backward and forward by driving the belt motor 513. The endless belt 512 is attached to the conveying casing 51 via a belt casing 514, and the belt motor 513 is attached to the conveying casing 51 via a motor bracket 515.

As described above, the cup stage 3 is connected to the belt conveying device 5 via the bracket 33, and the cup holder mechanism 4 is connected to the cup stage 3 via the bracket 33. This allows the cup stage 3 and cup holder mechanism 4 to be moved backward and forward when the belt motor 513 of the belt conveying device 5 is driven.

Figure 4:
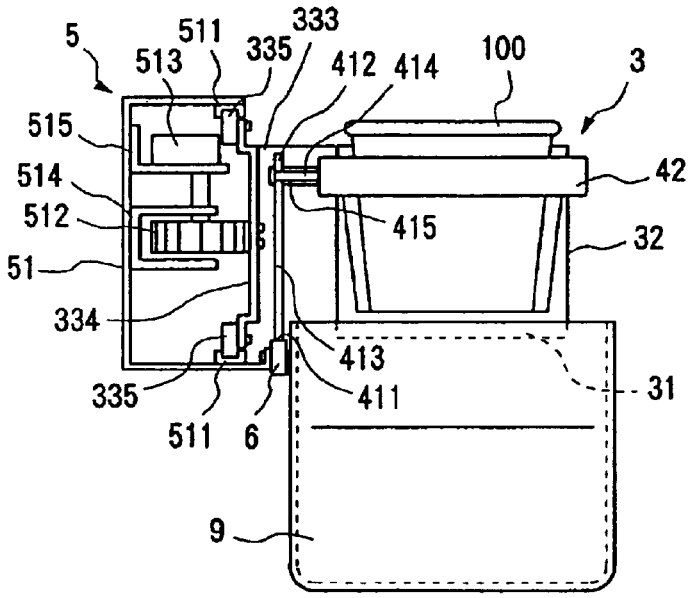
FIG. 4 is a front elevational view of an essential part of the cup-type beverage vending machine according to the first embodiment.

The cup-type beverage vending machine 1 has a support roller 6 for supporting the pivot arm 41 of the cup holder mechanism 4. As shown in FIG. 4, the support roller 6 is rotatably mounted on a side surface of the bottom plate of the conveying casing 51, and the lower edge 411 of the pivot arm 41 rests on the support roller 6 to regulate the pivot arm 41 so as not to be pivoted downward. When the cup stage 3 is on standby in the beverage pouring position P1 as shown in FIG. 5, that is, when the cup stage 3 is on standby below a cup supplying device 7 and beverage supplying nozzle 8, the lower edge 411 rests on the support roller 6 and the pivot arm 41 is horizontally supported. As a result, the holder 42 holds the cup 100 so as to cover the cup 100 from its front surface to its side surfaces. On the other hand, when the cup stage 3 is conveyed to the product taking-out position P2 as shown in FIG. 6, that is, when the cup stage 3 is conveyed just before the product taking-out port 23, the lower edge 411 is released from the support roller 6. As a result, the pivot arm 41 is pivoted downward by its self weight so that the holder 42 releases holding condition of the cup 100.

Located below the cup stage 3 is a drain receptacle 9 which moves in compliance with the cup stage 3. Thus, even in the case where the beverage spills from the cup 100 on the cup stage 3, the spilt water is received by the drain receptacle 9, and the spilt water received by the drain receptacle 9 is discharged into a drain tank 10 as shown in FIGS. 5 and 6.

Next, beverage vending operation of the cup-type beverage vending machine 1 will be described. When the beverage is not vended, as shown in FIG. 5, the cup stage 3 is on standby in the beverage pouring position P1. In this standby condition, when a coin is inserted into the coin insert 21 and then the product selecting button 22 is pushed, a cup 100 is supplied from the cup supplying device 7. The cup 100 passes between the holder 42 and cup holding block 32 to be located on the bottom wall 31 of the cup stage 3. At this time, the pivot arm 41 is supported at its tip side by the support roller 6, so that the holder 42 is positioned so as to cover the cup 100 from its side surfaces to its front surface to hold the cup 100. When the cup 100 is rested on the bottom wall 31, a predetermined amount of selected beverage is poured into the cup 100 from the beverage supplying nozzle 8. When pouring the beverage into the cup 100 is finished, the belt motor 513 is driven to turn the endless belt 512 and to move the cup stage 3 toward the product taking-out position P2, as shown in FIG. 6. As the cup stage 3 comes closer to the product taking-out position P2, the support roller 6 is relatively moved to the rear end side of the lower edge 411. Then, when the support roller 6 is relatively moved to backward of the pin 415, the support roller 6 releases supporting condition of the pivot arm 41, and the pivot arm 41 and holder 42 are pivoted downward around the pin 415. As a result, the holder 42 is released from the cup 100 and the front surface of the cup 100 is opened. Thereafter, as shown in dash-double-dot-lines in FIG. 6, the customer opens a door 231 and takes out the cup 100 from the cup stage 3, and as such the beverage is provided to the customer.

According to this embodiment, as described above, the cup 100 is held by the holder 42 during conveyance from the beverage pouring position P1 to the product taking-out position P2, while the holding condition of the cup 100 is released when the cup 100 reaches the product taking-out position P2. Accordingly, the cup 100 is prevented from falling during conveyance, and the customer can easily take out the cup 100.

Further, as described above, holding the cup 100 and releasing the holding condition of the cup 100 are carried out only by the pivot arm 41 and support roller 6, which provides extremely simple holding structure and holding releasing structure.

FIGS. 7 to 12 show a second embodiment of a cup-type beverage vending machine to which the present invention is applied. The same component parts as in the above described first embodiment will be represented by the same reference numerals and detailed descriptions thereof will be omitted as required.

The cup-type beverage vending machine according to the second embodiment has the same structure as the cup-type beverage vending machine according to the first embodiment in terms of its cup holder mechanism 4, belt conveying device 5, support roller 6, cup supplying device 7, beverage supplying nozzle 8, drain receptacle 9 and drain tank 10.

Figure 8:
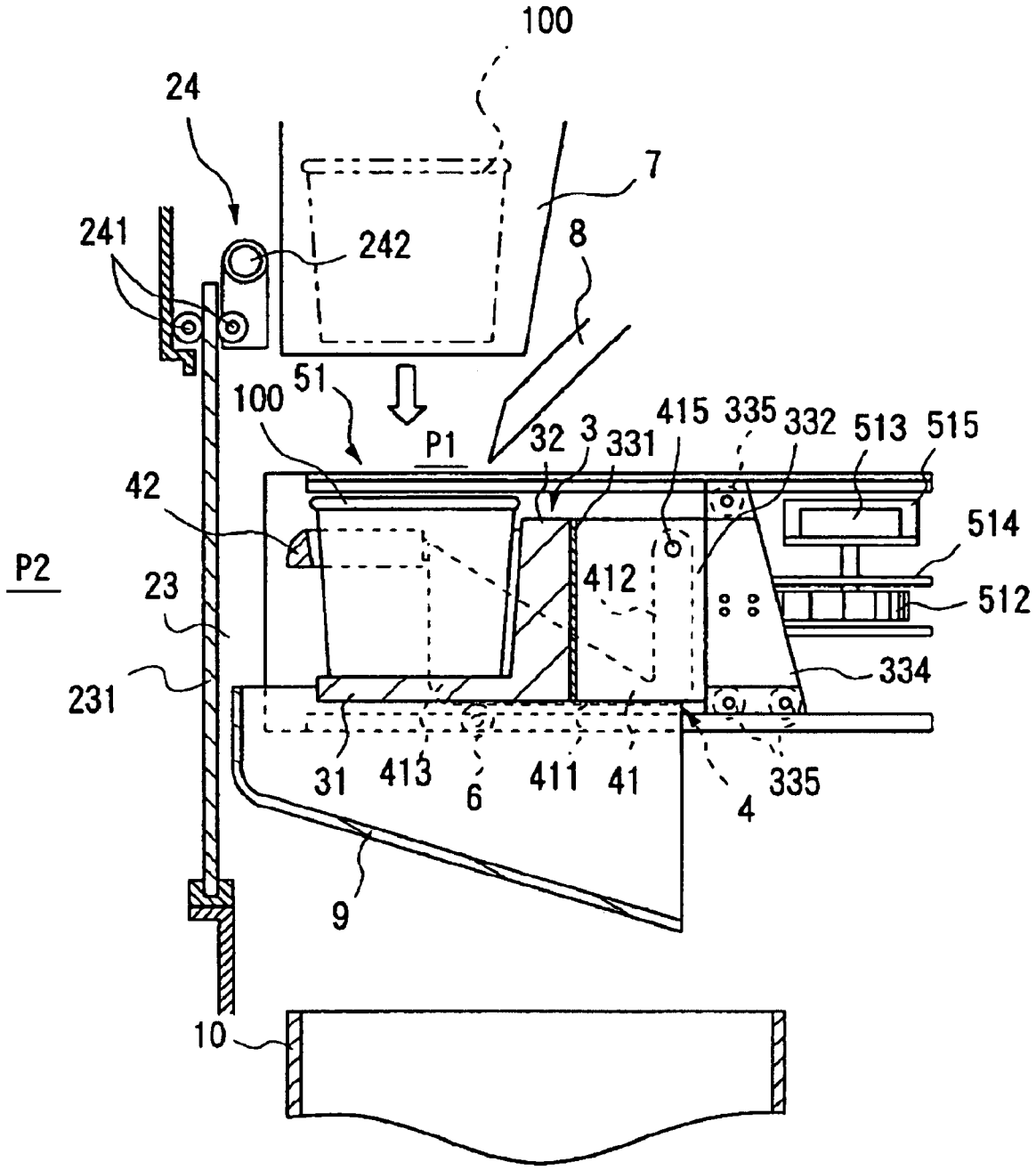
FIG. 8 is a side sectional view of a condition where a cup stage is on standby in a beverage pouring position in the second embodiment.
Figure 9:
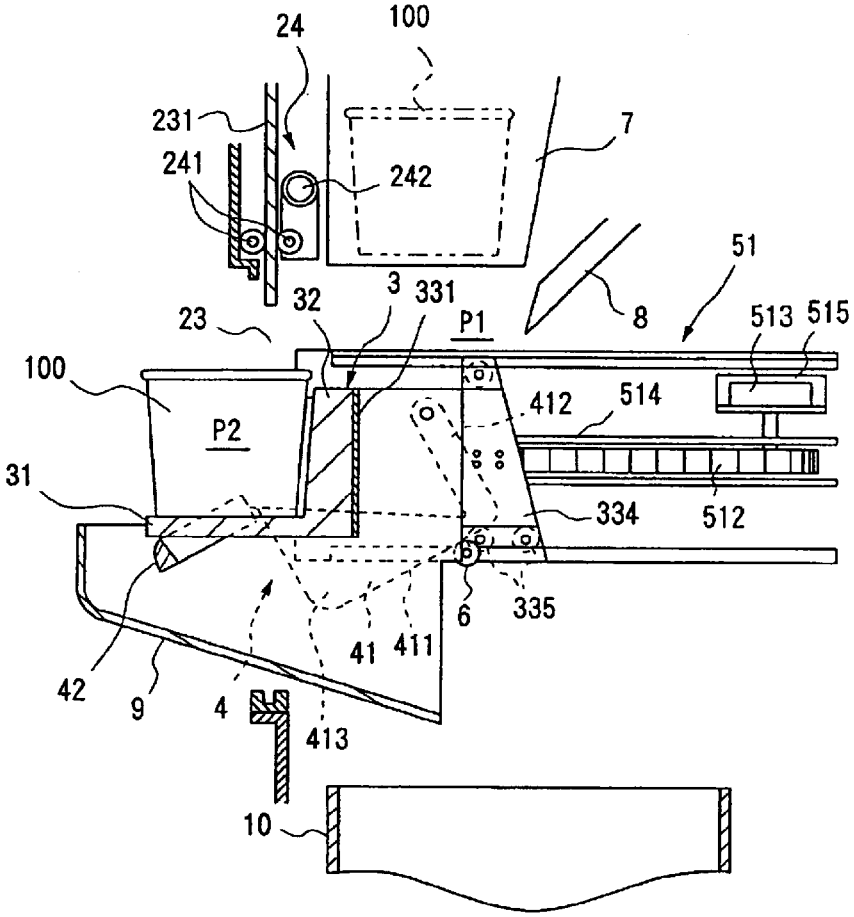
FIG. 9 is a side sectional view of a condition where the cup stage has been conveyed to a product taking-out position in the second embodiment.

As shown in FIGS. 8 and 9, the cup-type beverage vending machine according to the second embodiment has a beverage pouring position P1 set immediately inside a product taking-out port 23, and has a beverage taking-out position P2 set outside the product taking-out port 23. In order to realize such setting, as shown in FIGS. 8 and 9, the belt conveying device 5, support roller 6, cup supplying device 7, beverage supplying nozzle 8, drain receptacle 9 and drain tank 10 are located immediately inside the product taking-out port 23.

Located at the product taking-out port 23 is an opening device 24 for opening and closing a door 231. The opening device 24 is, as shown in FIGS. 8 and 9, configured from guide rollers 241 for holding the door 231 at its front and rear and a door motor (pulse motor) 242 for reversibly driving one of the guide rollers 241. When the door motor 242 is driven forward, the door 231 is raised to open the product taking-out port 23, while when the door motor 242 is reversed, the door 231 is lowered to close the product taking-out port 23.

Figure 7:
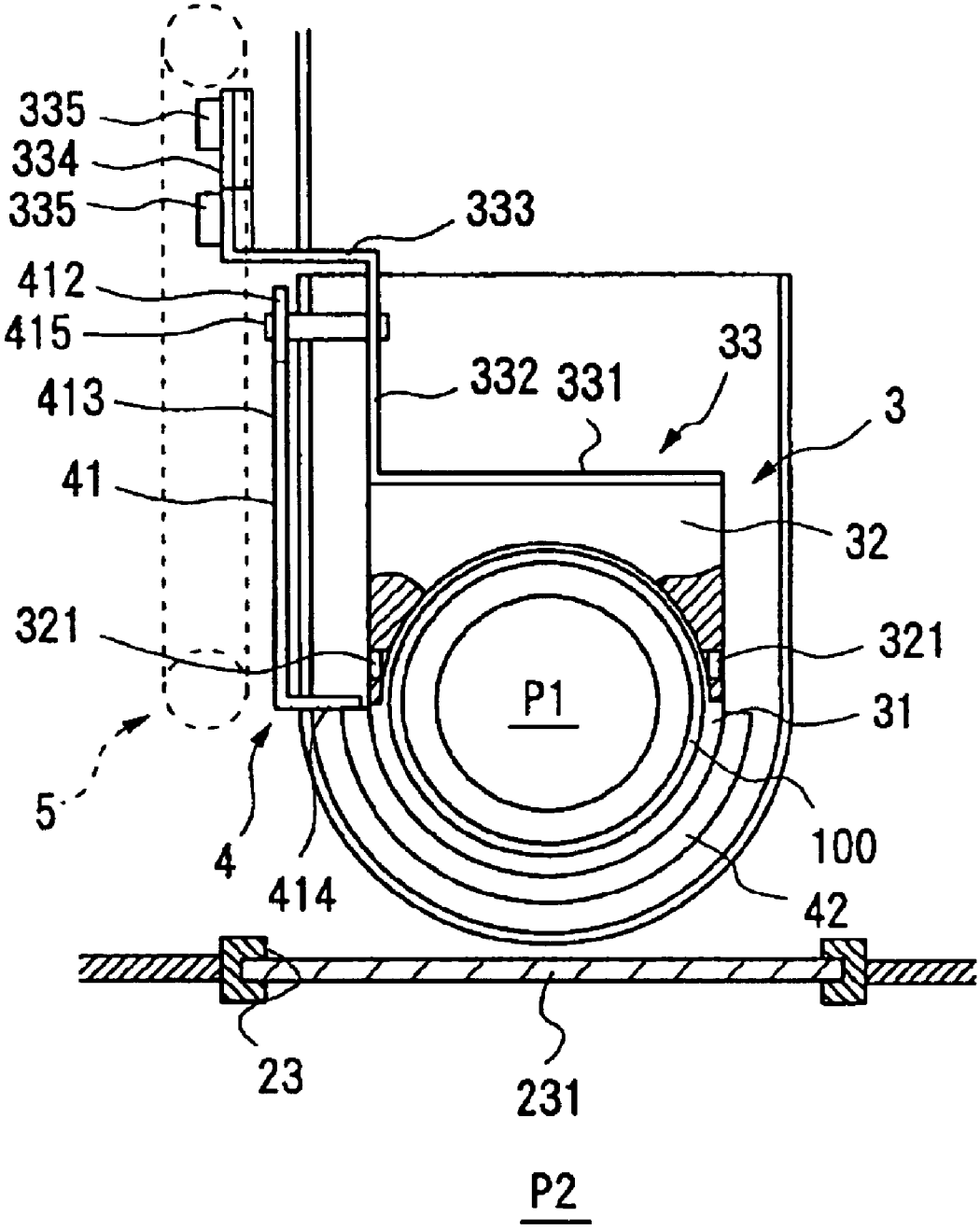
FIG. 7 is a plan view of an essential part of a cup-type beverage vending machine according to a second embodiment.

As shown in FIG. 7, a pair of sensors, for example, optical sensors 321 are embedded opposite on both side surfaces of a holding block 32 of a cup stage 3 and detect a cup 100 on the cup stage 3.

Figure 10:
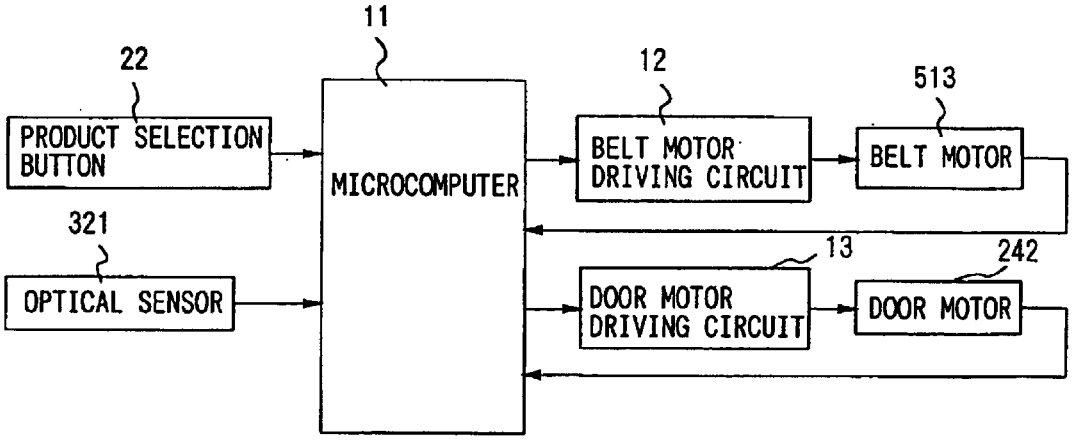
FIG. 10 is a block diagram showing a drive control circuit of a belt motor and a door motor according to the second embodiment.
Figure 11:
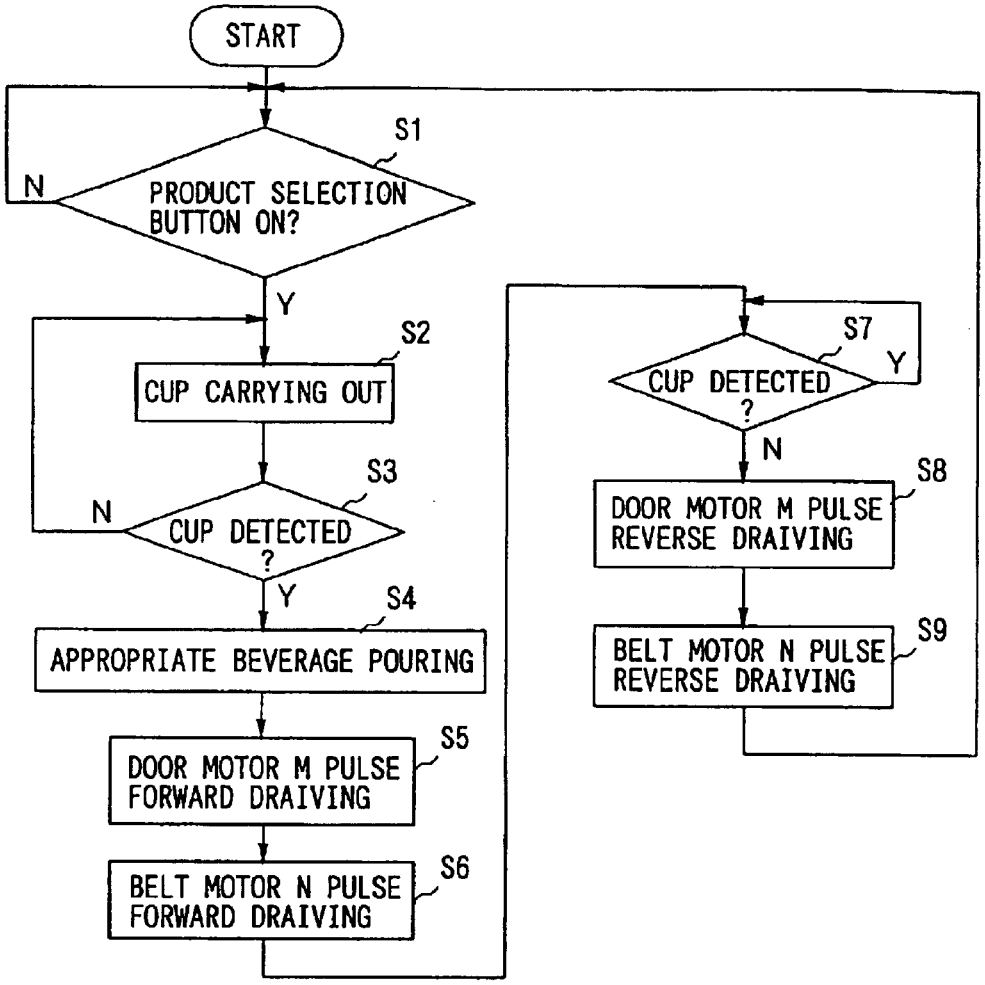
FIG. 11 is a flowchart showing a drive control circuit of a belt motor and a door motor according to the second embodiment.

In the cup-type beverage vending machine configured as the above, a vending control circuit of a cup beverage has a configuration as shown in FIG. 10. That is, a product purchasing signal of a product selecting button 22 and a cup detecting signal of the optical sensor 321 are received by a microcomputer 11, and based on the product purchasing signal and cup detecting signal, a belt motor 513 and door motor 242 are controlled via respective driving circuits 12, 13 as shown in the flowchart of FIG. 11.

When the beverage is not vended, as shown in FIG. 8, the cup stage 3 is on standby in the beverage pouring position P1. In this standby condition, when a coin is inserted into a coin insert 21 and then the product selection button 22 is pushed (S1), a cup 100 is supplied from the cup supplying device 7 (S2). The cup 100 passes between the holder 42 and cup holding block 32 to be located on the bottom wall 31 of the cup stage 3. At this time, the pivot arm 41 is supported at its tip side by the support roller 6, so that the holder 42 is positioned so as to cover the cup 100 from its side surfaces and its front surface to hold the cup 100. When the cup 100 is rested on the bottom wall 31, the optical sensor 321 detects the cup 100 (S3), and then a predetermined amount of selected beverage is poured into the cup 100 from the beverage supplying nozzle 8 (S4). When pouring the beverage into the cup 100 is finished, the door motor 242 is driven forward for M pulses (S5). This allows, as shown in FIG. 9, the door 231 to be raised to open the product taking-out port 23. After that, a belt motor 513 is driven forward for N pulses to turn an endless belt 512 (S6). This allows, as shown in FIG. 9, the cup stage 3 to pass through the product taking-out port 23 to move toward the product taking-out position P2 outside the product taking-out port 23. As the cup stage 3 comes closer to the product taking-out position P2, the support roller 6 is relatively moved toward the rear end side of the lower edge 411. Then, when the support roller 6 is relatively moved to backward of the pin 415, the support roller 6 releases supporting condition of the pivot arm 41, and, as shown in FIG. 9, the pivot arm 41 and holder 42 are pivoted downward around the pin 415. As a result, the holder 42 is released from the front surface of the cup 100 and the front surface of the cup 100 is opened. The customer can thereby take out the cup 100 from the cup stage 3. Then, when the optical sensor 321 does not detect the cup 100 on the cup stage 3, that is, when the customer takes out the cup 100 from the cup stage 3, the belt motor 513 is reversed for N pulses to reversely turn the endless belt 512 (S7, S8). This allows the cup stage 3 to pass through the product taking-out port 23 to return to the beverage pouring position P1 inside the product taking-out port 23. On the way back to the beverage pouring position P1 of the cup stage 3, the lower edge 411 of the pivot arm 41 is supported again by the support roller 6 and the cup holder mechanism 4 also returns to the former condition. When the returning process of the cup stage 3 is finished, the door motor 242 is reversed for M pulses (S9). This allows the door 231 to be lowered to close the product taking-out port 23.

According to the second embodiment, as described above, the product taking-out position P2 is positioned outside the product taking-out port 23 and there is no need for inserting a hand in the product taking-out port 23 to take out the cup 100 as the first embodiment, which further facilitates taking-out work of the cup 100. Other effects are the same as in the first embodiment and descriptions thereof will be omitted.

Figure 12:
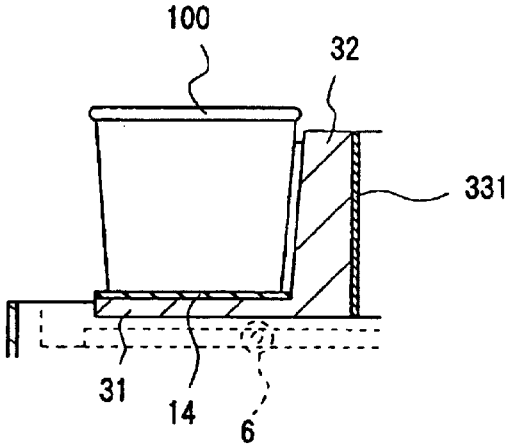
FIG. 12 is a side sectional view of another example of a cup sensor.

FIG. 12 shows another example of a cup sensor. In the above described second embodiment, the optical sensor 321 is used as the cup sensor, but a pressurized conductive rubber 14 may be used instead of the optical sensor 321. As shown in FIG. 12, the pressurized conductive rubber 14 in a plate shape is stuck on the bottom wall 31 of the cup stage 3. Resistance values of the pressurized conductive rubber 14 are different between when the cup 100 is located on the pressurized conductive rubber 14 of the cup stage 3 and when not located. Based on the difference in the resistance values, location of the cup 100 on the cup stage 3 is detected. The same effects as the optical sensor 321 is exerted in case of using the pressurized conductive rubber 14.

In each of the embodiments described above, the drain receptacle 9 is moved together with the cup stage 3, but the drain receptacle 9 may be fixed at the beverage pouring position P1 to move only the cup stage 3 and cup holder mechanism 4. Further, in each embodiment, the example of using the optical sensor 321 or pressurized conductive rubber 14 as the cup sensor was described. However, the sensor is not limited to this insofar as the cup 100 on the cup stage 3 can be detected, and, for example, a microswitch (not shown) may be embedded in the cup stage 3 to detect the cup 100.

What is claimed is:

1. A cup-type beverage vending machine, comprising:

a cup stage on which a cup is located;

a beverage pouring section for pouring beverage into a cup; and a conveying device for reciprocating the cup stage between a beverage pouring position and a product taking-out position, wherein said machine has:

a cup holder mechanism which holds the cup on said cup stage when the cup stage is situated other than said product taking-out position, while releases holding condition of the cup when the cup stage is situated in the product taking-out position;

a cup sensor for detecting the cup on the cup stage; and a control device which can control so as to pour the beverage from said beverage pouring section when the cup sensor detects the cup on the cup stage.

2. The cup-type beverage vending machine according to claim 1, wherein said control device can control said conveying device so as to move the cup stage to said product taking-out position after pouring the beverage into the cup.

3. The cup-type beverage vending machine according to claim 2, wherein said control device can control said conveying device so as to return the cup stage to said beverage pouring position when the cup sensor does not detect the cup after moving the cup stage to said product taking-out position.

4. The cup-type beverage vending machine according to claim 3, wherein the door of the product taking-out port is opened and closed by an opening device, and said control device can control the opening device so as to open the door after pouring the beverage into the cup.

5. The cup-type beverage vending machine according to claim 4, wherein said cup stage has a cup holding block formed so as to surround the cup from its side surfaces to its rear surface, and said cup senor is provided on a side surface of the cup holding block.

6. The cup-type beverage vending machine according to claim 5, wherein said cup sensor is an optical sensor.

7. The cup-type beverage vending machine according to claim 1, wherein said cup sensor is a pressurized conductive rubber located on a bottom wall of the cup stage.

8. The cup-type beverage vending machine according to claim 1, wherein said cup sensor is a microswitch embedded in a bottom wall of the cup stage.

* * * * *